US005662495A

United States Patent [19]

Inaba et al.

[11] Patent Number: 5,662,495

[45] Date of Patent: Sep. 2, 1997

[54] METHOD OF CONNECTING SHIELD WIRE TO CONNECTOR

[75] Inventors: Shigemitsu Inaba; Hidehiko Kuboshima; Satoki Masuda, all of Shizuoka, Japan

[73] Assignee: Yazaki Corporation, Tokyo, Japan

[21] Appl. No.: 448,312

[22] Filed: May 23, 1995

[30] Foreign Application Priority Data

May 23, 1994 [JP] Japan ..... 6-108650

[51] Int. Cl.[6] ..... H01R 9/03

[52] U.S. Cl. ..... 439/610

[58] Field of Search ..... 439/610, 578, 439/581, 583, 584, 585, 609

[56] References Cited

U.S. PATENT DOCUMENTS

| | | | |
|---|---|---|---|
| 4,408,822 | 10/1983 | Nikitas | 439/583 |
| 4,929,189 | 5/1990 | Sekiguchi | 439/610 |
| 4,995,832 | 2/1991 | Thommen et al. | 439/578 |
| 5,151,053 | 9/1992 | Shinji et al. . | |
| 5,267,878 | 12/1993 | Shinji et al. . | |
| 5,383,798 | 1/1995 | Lin | 439/578 |
| 5,429,529 | 7/1995 | Hashizawa et al. | 439/610 |
| 5,435,745 | 7/1995 | Booth | 439/583 |
| 5,501,615 | 3/1996 | Inaba et al. | 439/610 |

FOREIGN PATENT DOCUMENTS

| | | | |
|---|---|---|---|
| 9407282 | 3/1994 | France | 439/583 |
| 3-126374 | 12/1991 | Japan . | |
| 4-229575 | 8/1992 | Japan . | |

*Primary Examiner*—P. Austin Bradley
*Assistant Examiner*—Yong Ki Kim
*Attorney, Agent, or Firm*—Sughrue, Mion, Zinn, Macpeak & Seas

[57] ABSTRACT

A shield wire, having a shield mesh whose front end portion is folded back, is inserted into a shield contact member from a rear side thereof, so that the shield mesh is fitted in a wire fixing portion, and is fixed thereto at a spiral groove portion. Then, a terminal is fixedly secured to a front end of the shield wire, and the terminal is inserted into an electrically-conductive, hollow cylindrical shell, mounted within a housing, through an open, exposed rear end of the shell, so that a shell contact portion of the shield contact member is held against the rear end, and in this condition the shield wire is fixed to the housing.

6 Claims, 4 Drawing Sheets

METHOD OF CONNECTING SHIELD WIRE TO CONNECTOR

BACKGROUND OF THE INVENTION

1. Field of the Invention

This invention relates to a method of connecting a shield wire to a connector, as well as a connector construction, and more particularly to a method of connecting a shield wire to a connector having an electromagnetic shield function, as well as such a connector construction.

2. Related Art

In conventional connectors having an electromagnetic shield function, a housing of a resin is covered with a metal casing, or is plated at its outer surface with metal. However, since the metal casing or the metallic plating is exposed to the exterior, there has been encountered a problem that rust and corrosion have been liable to develop.

Under the circumstances, there is known a shield connector of the embedded type in which a metal shield box is integrally embedded in a connector housing of a resin by molding.

FIG. 11 is a cross-sectional view of such a conventional shield connector of the embedded type.

In this Figure, a shield box 103 of metal is embedded in a housing 102 made of a synthetic resin or the like, and only part of the shield box 103 is exposed to the interior of the housing 102, for example, at a rear portion of the housing 102 to provide an exposed portion 103A. Thus, most of the shield box 103 is embedded in the resin wall of the housing 102.

A conductor 107 of a shield wire 106 is secured to a terminal 105 by compressive clamping, and a braided shield portion 108 of the shield wire 106 is held in contact with an annular clamping portion 120 of a specially-produced, connecting member 110 of an electrically-conductive material. As a result, the connecting member 110 is electrically connected to the braided shield portion 108.

The terminal 105, gripping the shield wire 106, is inserted into the housing 102 from the rear side of the housing, and when the terminal 105 is fitted in the housing 102, a contact portion 109, formed at a rear end of the connecting member 110, contacts the exposed portion 103A of the shield box 103 provided in the housing 102. As a result, the braided shield portion 108 is electrically connected to the exposed portion 103A through the connecting member 110, thereby forming an electromagnetic shield wall.

In the shield connector of such a construction, however, the electrically-conductive connecting member 110 must be specially produced in accordance with the diameter of the shield wire 106, and in the case of using many kinds of shield wires 106 are used, there has arisen a problem that its cost increases. Another drawback is that the fitting of the connecting member 110 on the braided shield portion 108 can not be effected easily, so that the braided shield portion 108 has sometimes been damaged.

SUMMARY OF THE INVENTION

The present invention has been made in order to overcome the above drawback and problem, and an object of the invention is to provide a method of efficiently connecting a shield wire to an electromagnetic shield connector, and another object is to provide an inexpensive connector which can be manufactured at low costs.

The above object has been achieved by a method of connecting a shield wire to a connector, the connector comprising a housing containing an electrically-conductive, hollow cylindrical shell which has an open, exposed rear end, and can receive a terminal therein, and a shield contact member which has at its front portion a wire fixing portion for fitting on a shield mesh of the shield wire, and also has at its rear portion a shell contact portion formed integrally with the wire fixing portion in electrically-connected relation thereto, the wire fixing portion having a spiral groove in an inner side thereof, the shell contact portion being larger in diameter than the wire fixing portion, wherein the shield wire, having the shield mesh whose front end portion is folded back, is inserted into the shield contact member from a rear side thereof, so that the shield mesh is fixedly fitted in the wire fixing portion; subsequently, the terminal is fixedly secured to a front end of the shield wire; subsequently, the shield wire with the terminal is inserted into the shell from the rear side thereof, so that the shell contact portion of the shield contact member is held in contact with the rear end of the shell; and in this condition, the shield wire is fixed to the housing.

According to the invention, there is provided a connector construction comprising a housing containing an electrically-conductive, hollow cylindrical shell which has an open, exposed rear end, and receives a terminal therein; and a shield contact member which has at its front portion a wire fixing portion fitted on a shield mesh of a shield wire, and also has at its rear portion a shell contact portion formed integrally with the wire fixing portion in electrically-connected relation thereto, the wire fixing portion having a spiral groove in an inner side thereof, and the shell contact portion being held in contact with the rear end of the shell.

According to the invention, there is also provided a connector construction comprising a housing which contains an electrically-conductive, hollow cylindrical shell having an open exposed end, and has a terminal receiving chamber disposed within the shell; and a shield contact member which has at its front portion a coil spring-like wire fixing portion for fitting on a shield mesh of a shield wire, and also has at its rear portion a coil spring-like shell contact portion formed integrally with the wire fixing portion in electrically-connected relation thereto, the shell contact portion being larger in diameter than the wire fixing portion.

The shield wire, having the shield mesh whose front end portion is folded back, is inserted into the shield contact member from the rear side thereof, so that the shield mesh is fitted in the wire fixing portion, and then the shield wire is further pushed twistingly or straight, so that the shield mesh is fixedly secured to the spiral groove portion. Thereafter, the terminal is fixedly secured to the front end of the shield wire, and the shield wire is inserted into the shell through the rear end thereof, so that the shell contact portion of the shield contact member is held in contact with this rear end. In this condition, the shield wire with the terminal is fixed to the housing. Because of its reaction, the coil spring-like shell contact portion is firmly held against the rear end of the shell, thereby maintaining a good electrically-connected condition.

The shield mesh of the shield wire is fitted in the coil spring-like wire fixing portion defining the front portion of the shield contact member, and then the shield wire is pushed twistingly or straight, so that the spiral groove in the inner side of the coil spring-like wire fixing portion is brought into firm engagement with the shield mesh. This maintains a good electrically-connected condition, and also the shield wire with the shield mesh is prevented from being withdrawn from the shield contact member.

When the shell contact portion, defining the rear portion of the shield contact member, is held in contact with the open, exposed rear end of the electrically-conductive, hollow cylindrical shell mounted in the housing, the coil spring-like shell contact portion is compressed.

BRIEF DESCRIPTION OF THE PREFERRED EMBODIMENTS

DETAILED DESCRIPTION OF THE PREFERRED EMBODIMENTS

A preferred embodiment of the present invention will now be described with reference to the drawings.

For convenience' sake, a preferred embodiment of a connector construction of the invention will be first described, and then a connecting method of the invention will be described.

Figure 1:
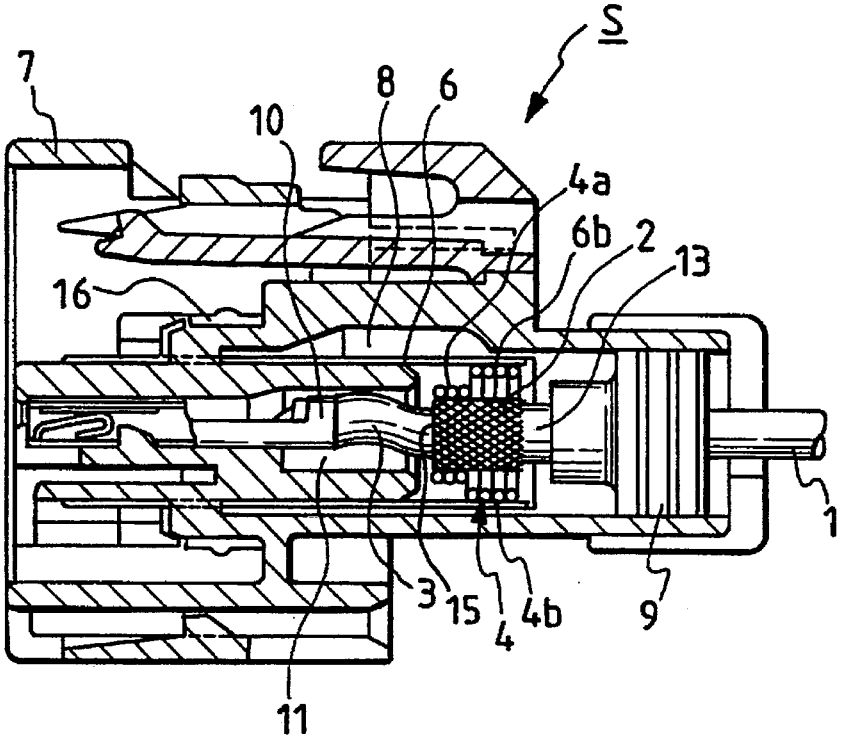
FIG. 1 is a cross-sectional view of a preferred embodiment of a connector of the present invention.

FIG. 1 is a longitudinal cross-sectional view of an overall construction of the preferred embodiment of the connector of the invention.

In this Figure, the connector S of the invention includes a shell 6 of metal mounted within a housing 7, and a shield contact member 4 of metal held in contact with the shell 6.

The shell 6 and the shield contact member 4 do not always need to be made of metal in so far as they have an electrically-conductive nature. For example, they may be made of a metal-plated resin, or an electrically-conductive resin. Although the connector S of the invention shown in FIG. 1 is designed to receive a female terminal, it may be of such a design as to receive a male terminal.

The construction of the shield contact member 4 will first be described with reference to FIG. 2.

Figure 2:
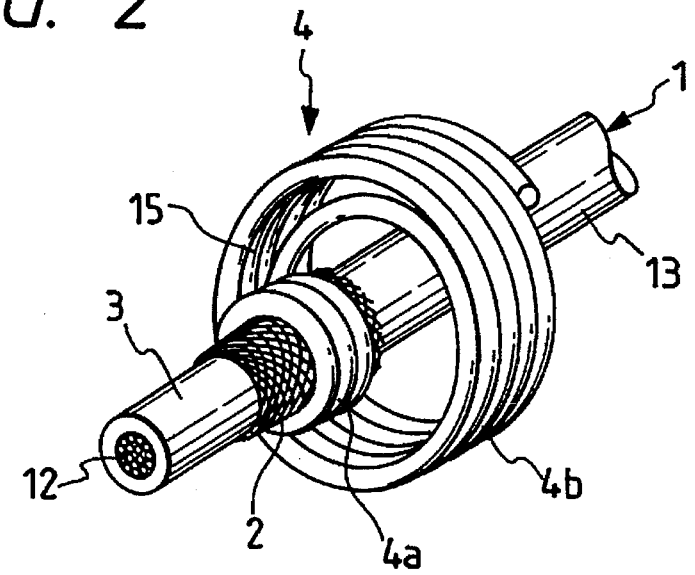
FIG. 2 is a perspective view showing a shield contact member and a shield wire.

In FIG. 2, the coil spring (shield contact member) 4 has a front portion defining a coil spring-like wire fixing portion 4*a*, and a rear portion defining a coil spring-like shell contact portion 4*b*, the two portions 4*a* and 4*b* being integrally connected together. The coil spring (shield contact member) 4 is resilient, and has a spiral groove 15 in its inner side. A shield wire 1 is fitted in the wire fixing portion 4*a*.

Figure 3:
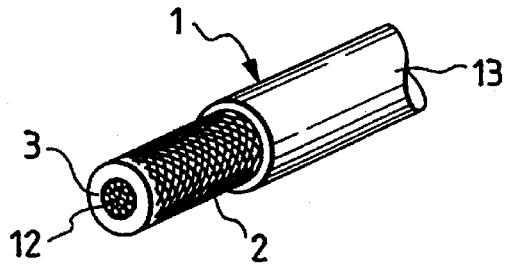
FIG. 3 is a perspective view showing the manner of processing the shield wire.
Figure 4:
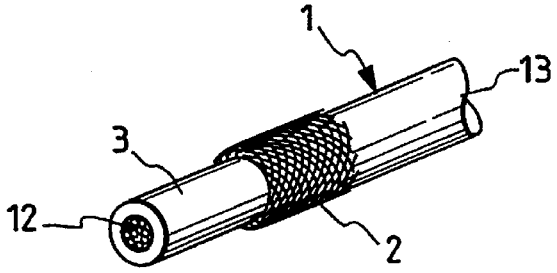
FIG. 4 is a perspective view showing the manner of processing the shield wire.

FIGS. 3 and 4 are perspective views showing the manner of processing the shield wire.

The shield wire 1 has a shield mesh 2 fitted on an insulator 3 covering a conductor 12, and a sheath 13 covers this shield mesh. The sheath 13 is removed at a front end portion of the shield wire 1 as shown in FIG. 3, and the exposed shield mesh 2 is folded back as shown in FIG. 4.

Figure 5:
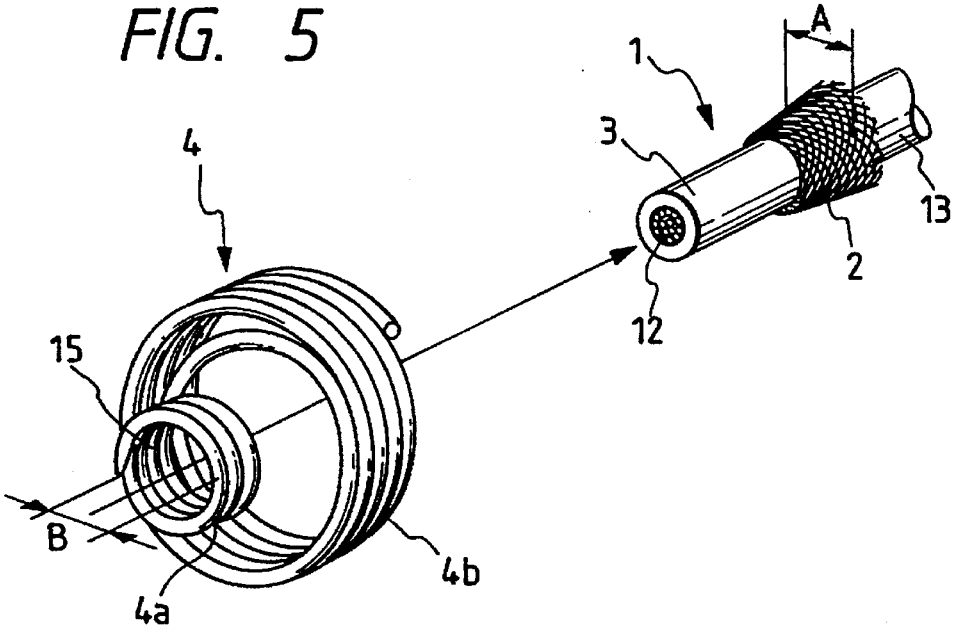
FIG. 5 is a perspective view showing the manner of fitting the shield contact member on the shield wire.
Figure 6:
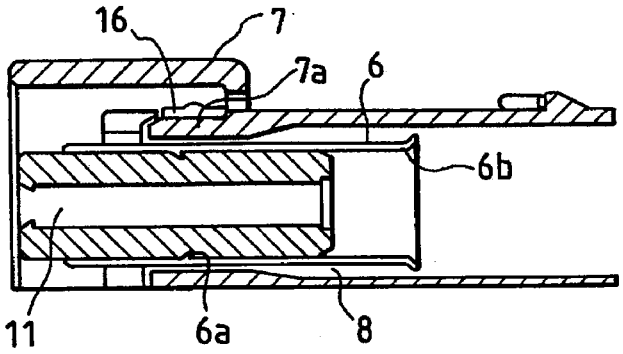
FIG. 6 is a cross-sectional view of a housing.

FIG. 5 is a perspective view showing the manner of fitting the shield contact member on the shield wire. In this Figure, a dimension or diameter of the folded-back portion of the shield mesh 2 is represented by A. A dimension B of the coil spring-like wire fixing portion 4*a* of the shield contact member 4 is slightly smaller than the dimension A of the shield mesh 2.

The shield contact member 4 is fitted over the front end portion of the shield wire 1 in such a manner that the wire fixing portion 4*a* is fitted on the shield mesh 2, as shown in FIG. 5.

Since the shield mesh 2 is slightly larger than the wire fixing portion 4*a* as described above, the shield contact member 4 is fitted on the shield mesh 2 in a twisting manner. At this time, the shield mesh 2 is compressed radially inwardly, and at the same time the wire fixing portion 4*a* is slightly expanded radially outwardly, so that the wire fixing portion 4*a* is fixedly fitted on the shield wire 1.

Instead of twistingly fitting the shield contact member 4, it may be pushed to be fitted on the shield mesh 2.

The above fixed condition is shown in FIG. 2 which is a perspective view. As described above, the shield mesh 2 of the shield wire 1 is inserted into the coil spring-like wire fixing portion 4*a* defining the front portion of the shield contact member 4, and then is twisted or pushed forward, so that the spiral groove 15 in the inner side of the spring-like wire fixing portion 4*a* firmly grips the shield mesh 2. As a result, a good electrically-connected condition is obtained, and besides the shield wire 1 including the shield mesh 2 is firmly fixed to the shield contact member 4, and therefore is prevented from being withdrawn therefrom.

In this electromagnetic shield connector construction of the invention, the shield contact member for connection to the shield mesh of the shield wire is constituted by the coil spring, and therefore the shield contact member can be mounted much more easily as compared with the conventional connecting member.

And besides, any special mold or the like is not required for producing the shield contact member of the invention, and the cost of the parts can be reduced.

Next, the construction of the shell 6 will now be described.

The shell 6 has an electrically-conductive, hollow cylindrical body, and is received in a shell-receiving portion 8 in the housing 7 of a resin. Retaining pawls 6*a* may be formed on an inner or an outer periphery of the shell 6 to retain the shell 6 relative to the housing 7. The housing 7 has a terminal receiving chamber 11 disposed within the shell 6.

The hollow cylindrical shell 6 is provided within the housing 7, and extends from a region near to a front end of the housing, and terminates short of a rear end thereof, and a rear end 6*b* of the shell 6 is open and exposed.

The rear end 6*b* of the shell 6 is thus open and exposed, and the shell contact portion 4*b* defining the rear portion of the coil spring 4 is inserted into the housing 7, and then the coil spring-like shell contact portion 4*b*, when engaged with the rear end 6*b*, is compressed. Because of its reaction, the shell contact portion 4*b* is firmly held against the rear end portion 6*b* of the shell. As a result, a good electrical connection between the shell contact portion 4*b* and the shell 6 is maintained.

Part of the housing 7, receiving the shell 6, has a double partition wall construction, and a packing 16 is mounted on a partition wall 7*a* which is fitted in a mating connector (not shown) when the mating connector is inserted into the housing, and this packing forms a watertight seal between the two connectors connected together.

Figure 7:
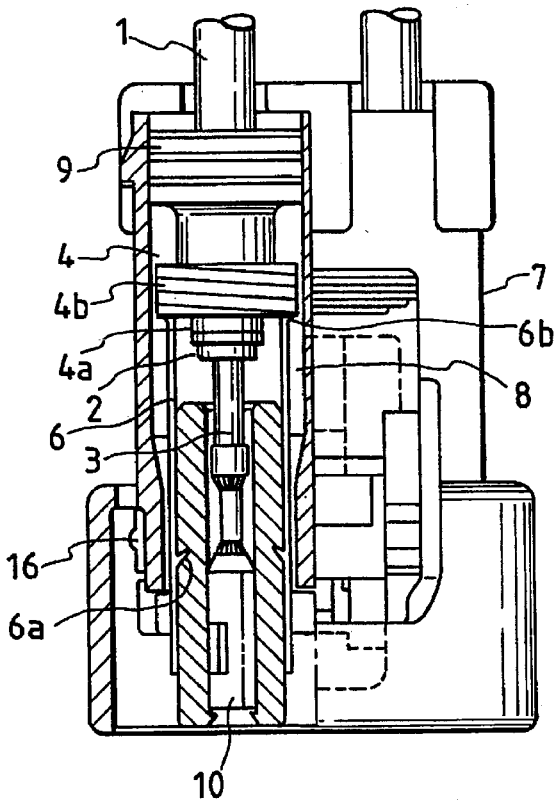
FIG. 7 is a partly cross-sectional, top plan view of a modified connector of the invention.
Figure 8:
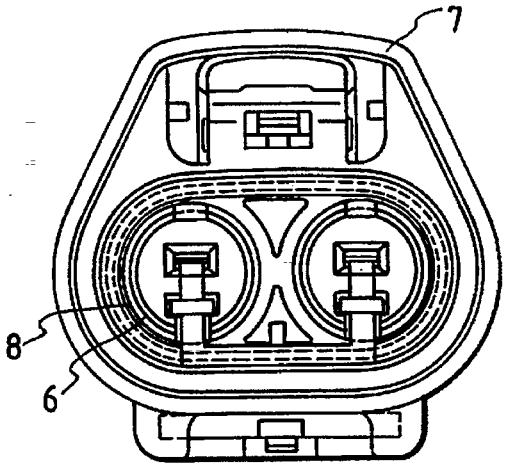
FIG. 8 is a front-elevational view of the connector of FIG. 7.

A method of the invention for fittingly connecting the shield wire to the connector of the above construction will now be described with reference to FIGS. 1, 7 and 8.

In the method of the invention for connecting the shield wire to the connector, the housing 7 and the shield contact member 4 are used as described above. A terminal 10 is adapted to be inserted into the electrically-conductive, hollow cylindrical shell 6 provided in the housing within which the rear end of the shell 6 is open and exposed. The shield contact member 4 has the front portion defining the wire fixing portion 4*a* for fitting on the shield mesh 2 of the shield wire 1, and also has the rear portion defining the shell contact portion 4*b* which is formed integrally with the wire fixing portion 4*a*, and is larger in diameter than the wire fixing portion 4*a*.

First, the shield wire 1, having the shield mesh 2 whose front portion is folded back, is inserted into the shield contact member 4 from the rear side of this shield contact member, and is twisted or pushed forward. As a result, the shield mesh 2 is fixedly secured to the shield contact member 4 at the spiral groove 15. The terminal 10 is fixedly secured to the front end of the shield wire 1 having the shield contact member 4 fixed thereto.

The shield wire 1 with the terminal is inserted into the hollow cylindrical shell 6 through the open, exposed rear end 6*a* thereof, and is moved toward the front end of the shell 6. The shield wire 1 with the terminal thus advances within the shell 6, and the shell contact portion 4*b* of the shield contact member 4 is brought into contact with the rear end portion 6*b* of the shell 6. While holding the shell contact portion 4*b* in contact with the rear end portion 6*b*, a rubber plug 9 fitted on the shield wire 1 is pushed into the housing 7, thereby fixing the shield wire.

If the outer diameter of the shell contact portion 4*b* is substantially equal to the inner diameter of the shell 6, the shell contact portion 4*b* can be snugly fitted into the shell 6. This contact condition is shown in FIG. 1.

If the outer diameter of the shell contact portion 4*b* is larger than the outer diameter of the shell 6, the shell contact portion 4*b* is firmly abutted against the rear end 6*b* of the shell 6. This abutted condition is shown in FIG. 7.

In this condition, the shell contact portion 4*b* is held in contact with the rear end portion 6*b* of the shell 6 with a sufficient pressing force, so that a good electrical connection is made between the shield contact member 4 and the shell 6.

As a result, there is formed a continuous shield wall extending from the shield mesh 2 to the front end of the shell 6 via the shield contact member 4.

Figure 9:
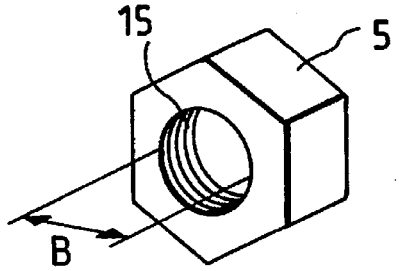
FIG. 9 is a perspective view of a modified shield contact member.
Figure 10:
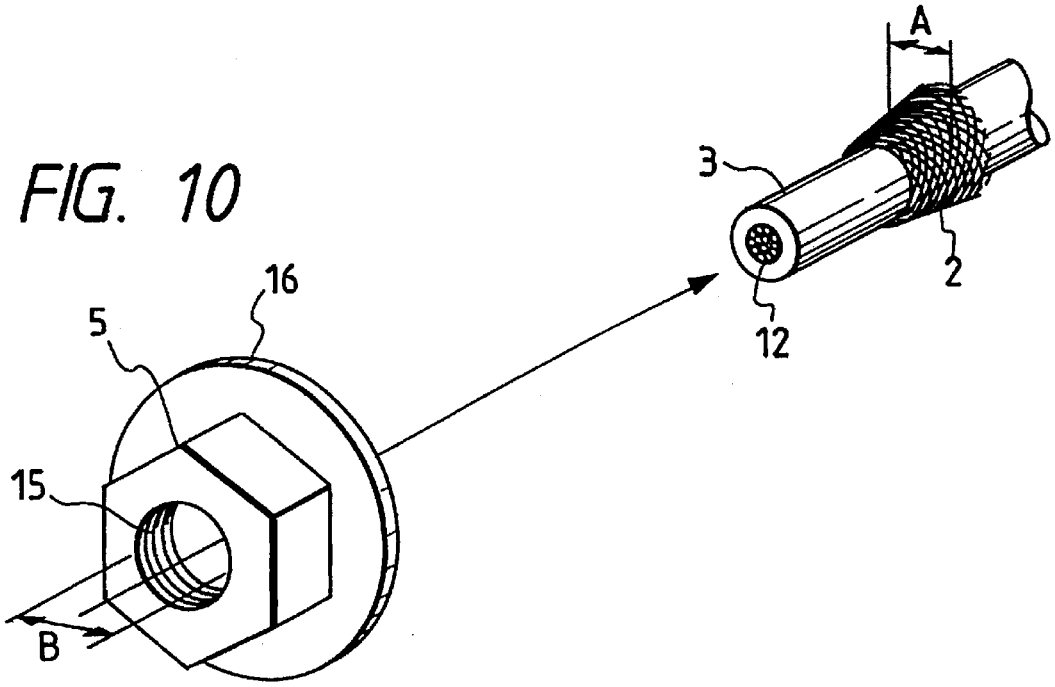
FIG. 10 is a perspective view of another modified shield contact member.
Figure 11:
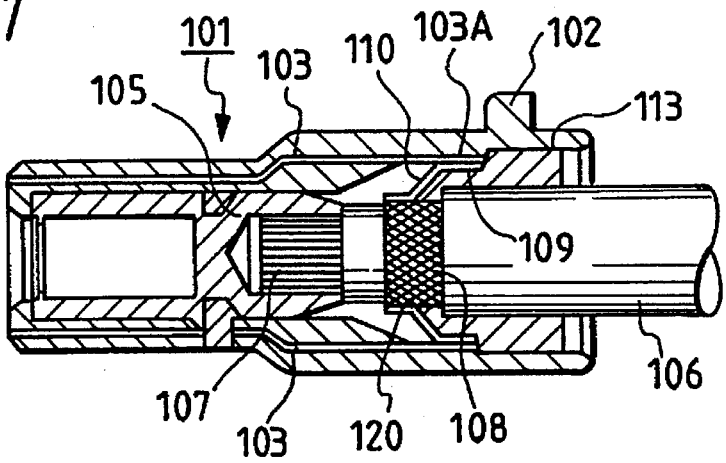
FIG. 11 is a cross-sectional view of a conventional shield connector.

In the method of the invention for connecting the shield wire to the connector, the shield contact member is not limited to the above-mentioned coil spring 4, and nuts 5 shown respectively in FIGS. 9 and 10 can be used as the shield contact member. The nut 5 of FIG. 9 is abutted at its front side against the rear end of the shell 6.

The nut 5 of FIG. 10 has a flange 16 formed at a rear end thereof, and the front side of this nut is abutted against the rear end of the shell 6 at an outer peripheral portion of the nut 5. In these nuts 5, a threaded groove therein performs the same function as the spiral groove 15.

In the above embodiment, the connector used in the connecting method of the invention is designed to receive the female terminal, the connector may be designed to receive a male terminal.

When a pair of connectors, which respectively receive a female terminal and a male terminal, are connected together in the connecting method of the invention, front ends of shells provided respectively in housings of the two connectors are disposed in opposed relation to each other, so that the interiors of the two connectors are effectively shielded electromagnetically. Thus, when the pair of connectors are connected together, a completely-closed electromagnetic shield construction is achieved.

The rear end portion of the housing 7 is hermetically sealed by the rubber plug 9 through which the shield wire 1 is passed, and the packing 16 forms a watertight seal between the connector and the mating connector. Therefore, a satisfactory waterproof effect is achieved.

As described above, in the method of connecting the shield wire to the connector according to the invention, the shield mesh of the shield wire is fitted in the wire fixing portion defining the front portion of the shield contact member, and then the shield wire is pushed twistingly or straight, and the terminal is secured to the shield wire, and the shield wire is inserted into the shell mounted within the housing. Thus, with such a simple operation, the good electrically-connected condition, as well as the firmly-fixed condition, can be achieved, and therefore the mounting operation can be carried out quite easily.

In the connector of the invention, the spiral groove in the inner side of the shield contact member having the coil spring-like wire fixing portion is held in firm engagement with the shield wire, and therefore not only the good electrically-connected condition is obtained, but also shield wire is prevented from being withdrawn from the shield contact member.

When the shell contact portion is brought into contact with the rear end of the shell, the coil spring-like shell contact portion having resiliency is compressed, and because of its reaction, the shell contact portion strongly urges the rear end of the shell, so that the good electrically-connected condition is maintained between the shell contact portion and the shell.

And besides, since the shield contact member comprises a coil spring, any special mold or the like is not required for producing the shield contact member, and the cost of the parts can be reduced. Therefore, there is provided an excellent industrial advantage that the inexpensive connector can be provided at low manufacturing costs.

What is claimed is:

1. A connector assembly comprising:

a housing containing an electrically-conductive, hollow cylindrical shell having an open exposed end, said shell having a terminal receiving chamber disposed within said shell; and a shield contact member having at its front portion a wire fixing portion for fitting on a shield mesh of a shield wire, and at its rear portion a shell contact portion formed integrally with said wire fixing portion in electrically-connected relation thereto, wherein said wire fixing portion and said shell contact portion each includes spring-like coils and said shell contact portion is larger in diameter than said wire fixing portion.

2. A connector assembly as claimed in claim 1, wherein the shell contact portion is electrically connected to said open exposed end of said hollow cylindrical shell.

3. A connector assembly as claimed in claim 1, wherein the shell contact portion is inserted into said hollow cylindrical shell to electrically connect said hollow cylindrical shell.

4. A connector assembly comprising:

a housing containing an electrically-conductive, hollow cylindrical shell having an open exposed end, said shell having a terminal receiving chamber disposed within said shell; and a shield contact member having at its front portion a wire fixing portion for fitting on a shield mesh of a shield wire, and at its rear portion a shell contact portion formed integrally with said wire fixing portion in electrically-connected relation thereto, wherein said wire fixing portion includes a nut-like member, said shell contact portion includes a flange portion, and said shell contact portion is larger in diameter than said wire fixing portion.

5. A connector assembly comprising:

a housing containing an electrically-conductive, hollow cylindrical shell having an open exposed end, said shell having a terminal receiving chamber disposed within said shell; and a shield contact member having at its front portion a wire fixing portion for fitting on a shield mesh of a shield wire, and at its rear portion a shell contact portion formed integrally with said wire fixing portion in electrically-connected relation thereto, wherein, at least one of said wire fixing portion and said shell contact portion is shaped in a spiral at an inner portion thereof.

6. A connector assembly of claim 1, wherein each of said wire fixing portion and shell contact portion includes a plurality of turns of wire having substantially the same diameter.

* * * * *